United States Patent [19]

Rausing et al.

[11] 4,027,455

[45] June 7, 1977

[54] PACKING CONTAINERS WITH RIPPING THREAD OPENING AND PACKING MATERIAL WEBS FOR THE MANUFACTURE OF THE PACKING CONTAINERS

[75] Inventors: Ruben Rausing, Rome, Italy; Gert Nedstedt, Malmo, Sweden; Hakan Holmstrom, Loberod, Sweden; Lars-Erik Palm, Staffanstorp, Sweden; Stjepan Stefan, Dalby, Sweden

[73] Assignee: Tetra Pak Developpement SA, Lausanne, Switzerland

[22] Filed: Apr. 28, 1975

[21] Appl. No.: 572,092

Related U.S. Application Data

[62] Division of Ser. No. 331,886, Feb. 12, 1973, abandoned.

[30] Foreign Application Priority Data

Mar. 14, 1972 Switzerland ..... 3691/72

[52] U.S. Cl. ..... 53/14; 53/28; 93/1 TS; 229/51 AS

[51] Int. Cl.[2] ..... B65B 61/18

[58] Field of Search ..... 93/1 TS, 35 DS, 36 DA; 53/14, 28, 133, 180 M, 182 M; 229/51 AS, 51 TS, 51 S

[56] References Cited

UNITED STATES PATENTS

| | | | |
|---|---|---|---|
| 2,268,668 | 1/1942 | Moore | 93/1 TS |
| 2,294,220 | 8/1942 | Albertson | 53/14 |
| 2,370,079 | 2/1945 | Schmidt | 93/1 TS |
| 2,683,401 | 7/1954 | Smith | 93/1 TS |
| 2,758,517 | 8/1956 | Brightwell | 93/1 TS |
| 3,080,238 | 3/1963 | Kraft | 229/51 AS |
| 3,090,285 | 5/1963 | Carlson | 93/1 TS |
| 3,263,391 | 8/1966 | Wallsten | 53/28 |
| 3,402,875 | 9/1968 | Palmer | 229/51 TS |
| 3,426,499 | 2/1969 | Paige | 53/28 |
| 3,438,563 | 4/1969 | Collura et al. | 229/51 S X |

*Primary Examiner*—Travis S. McGehee
*Assistant Examiner*—J. Sipos
*Attorney, Agent, or Firm*—Pierce, Scheffler & Parker

[57] ABSTRACT

In a packing container of the type comprising two sealing joints crossing each other whereby a sealing joint forms a sealing fin in which the packaging material is joined inside to outside, a ripping strip or thread is provided adjacent the inside of the sealing fin and with a portion thereof accessible from the exterior of the container.

8 Claims, 16 Drawing Figures

Figure 1:
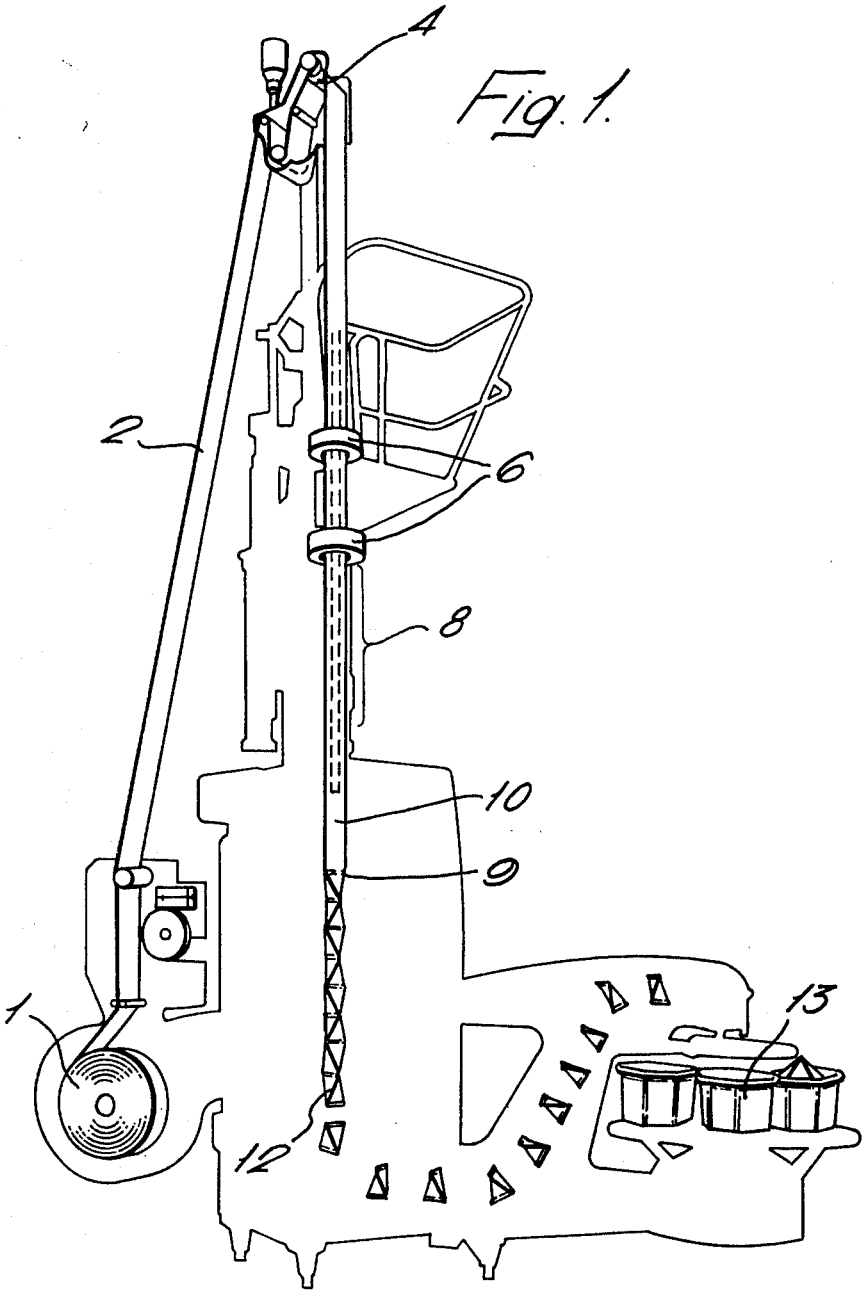

4
6
8
9
2
10
11
3
5
1

PACKING CONTAINERS WITH RIPPING THREAD OPENING AND PACKING MATERIAL WEBS FOR THE MANUFACTURE OF THE PACKING CONTAINERS

This is a division, of application Ser. No. 331,886 filed Feb. 12, 1973 now abandoned.

The present invention concerns a packing container of the type comprising two sealing joints crossing each other, whereby at least one of said sealing joints forms a sealing fin in which the packing material is joined inside to inside, and preferably of the type which is manufactured from a thermoplastic-coated material web in that the longitudinal edges of the web are united in a longitudinal joint to form a tube, which is filled with the intended filling material, whereupon the tube formed by repeated flattenings and sealing along narrow zones perpendicular to the tube axis is divided into container units, which are possibly subjected to a subsequent forming work and separation from the tube by means of cuts in the said zones. The invention also concerns a packing material web intended for the manufacture of packing containers of the aforementioned type, which packing material web consists of a casing layer, which at least on the side which is intended to form the inside of the packing container has a coating of thermoplastic material, e.g. polythene.

It has been known in packaging technique for a long time past that packages can be made from a web, which for example can be stored in the form of a roll, which web can be folded into the shape of a tube in that the longitudinal edges of the web are united with each other along a longitudinal joint, whereupon the tube formed in accordance with what has been said above is filled with the intended filling material and separated by means of transverse sealing perpendicular to the tube axis to individual packaging units, which can be separated from the tube by cutting in the said transverse sealing zones. In this manner so-called cushion-shaped packages can be manufactured if the sealing jaws flatten and seal the tube in the same sealing plane, or also tetrahedron-shaped packing units, which are obtained when the sealing jaws are pressed against the tube in such a manner that two seals following one another come to be set at an angle against one another. It is also possible to carry out after or in connection with the sealing a forming work so as to shape the lower part of the tube so that it receives a parallelepipedic form with four side walls facing one another in pairs and two end walls facing one another, which are formed by upsetting of the tube with simultaneous forming of double-walled triangular lugs at the corner of the parallelepipedic packages.

The packages of the abovementioned type can be opened by cutting off or clipping off a small portion of the corner part, so that the filled material becomes accessible and they can also be provided with weakenings in the package walls which permit that for example a corner part or a part of the sealing fin can be ripped off relatively easily by providing the packing material with a weakening perforation.

To apply a knife, scissors or other mechanical auxiliary for opening of a package is inconvenient however, since an implement of the abovementioned kind is not always available when the packing containers are to be opened, and easily tearable ripping facilities have the disadvantage that the packing walls are weakened by ripping perforations and the like, so that the opening facilities may be broken open unintentionally during transport or handling of the packing containers.

It is also known per se that packages can be opened by means of a ripping thread inserted in the package or in the seal of the package by means of which the package wall can be cut open. Such ripping thread have only been used in the known packages, however, in the case where the package is manufactured from separate blanks of material and the ripping threads are inserted therefore separately in each blanks of packing material before the same has been shaped into package unit. The difficulty in the introduction of ripping thread in package containers which are manufactured from a web which is folded to a tube has been that the ripping thread is cut when the parts of the tube divided by transverse sealing are separated from the remaining tube, which meant that the ripping thread was not accessible from the outside of the package when the package was to be opened. This disadvantage has been overcome, however, in the packing container in accordance with the invention in that this container along and under at least one of the said sealing joints or sealing zones is provided with a ripping thread or a ripping strip, parts of which are accessible from the outside of the package in that the said parts projects from the sealing joint, which forms the longitudinal joint of the abovementioned tube.

Figure 2:
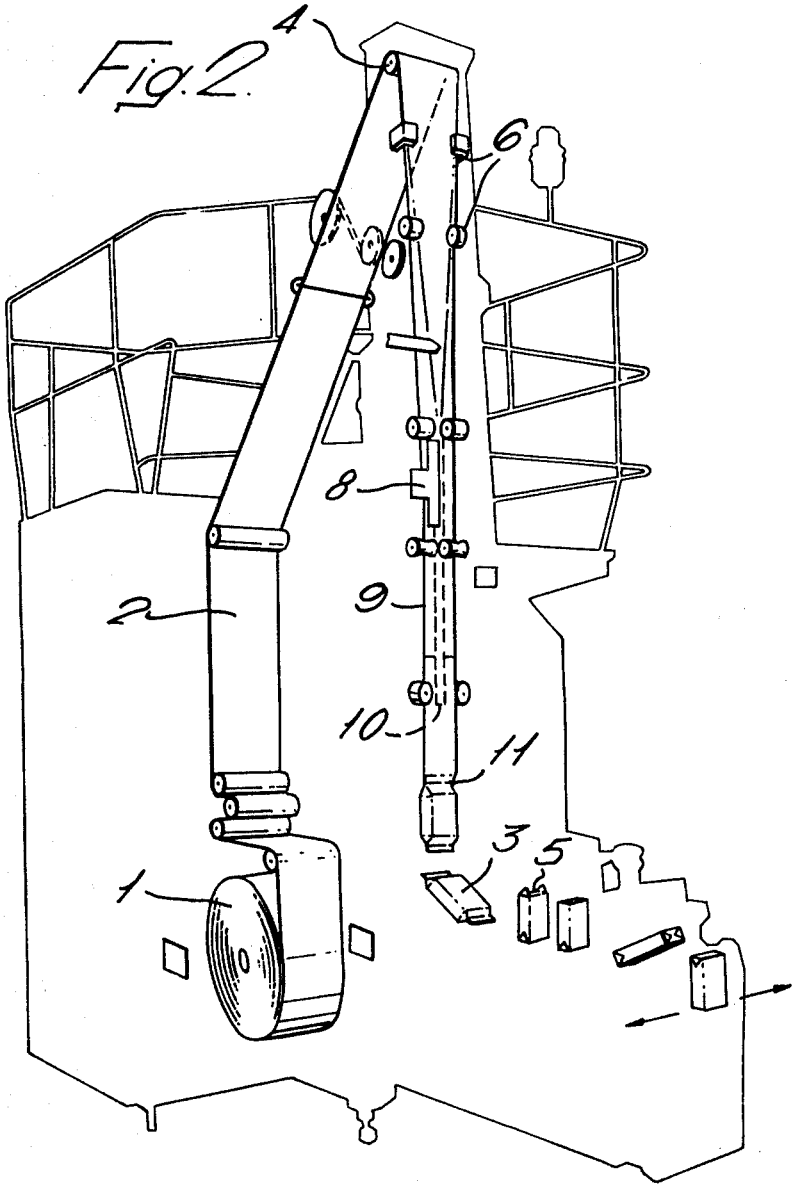
Figure 3:
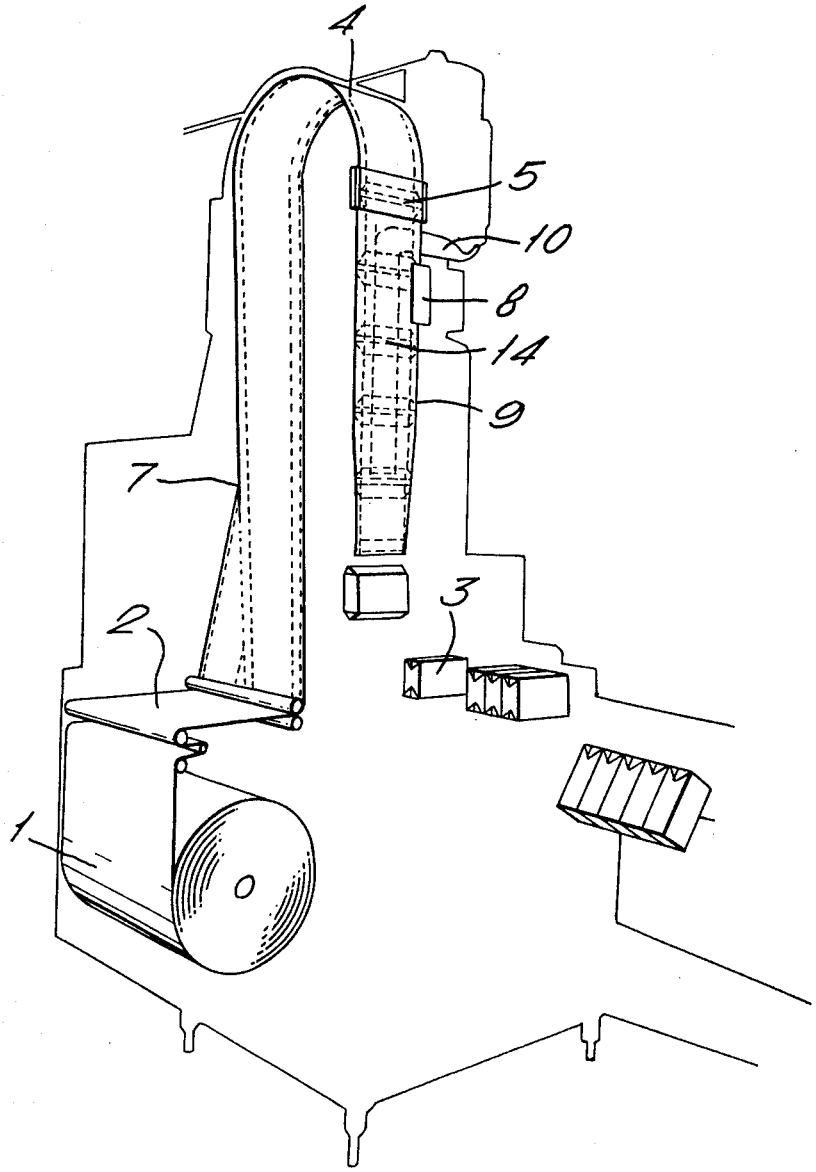
Figure 4:
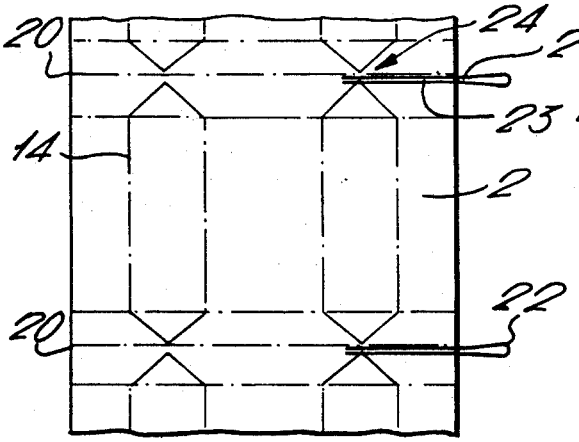
Figure 5:
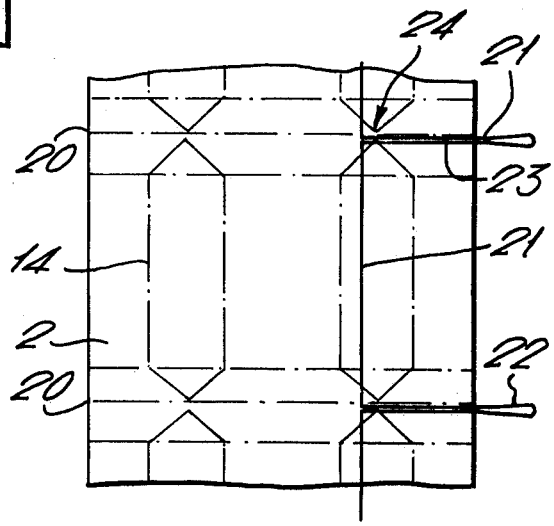
Figure 6:
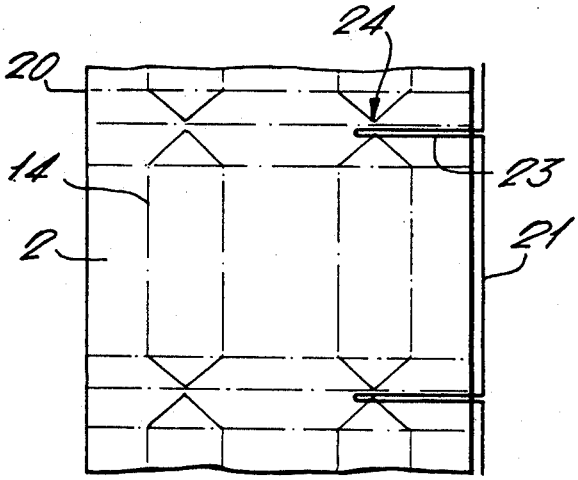
Figure 7:
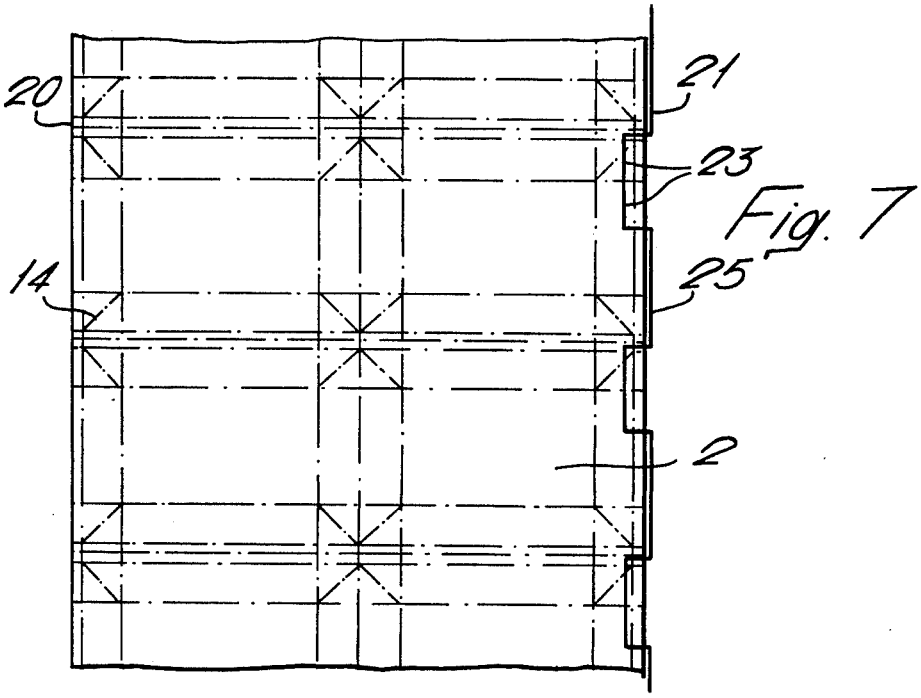
Figure 8:
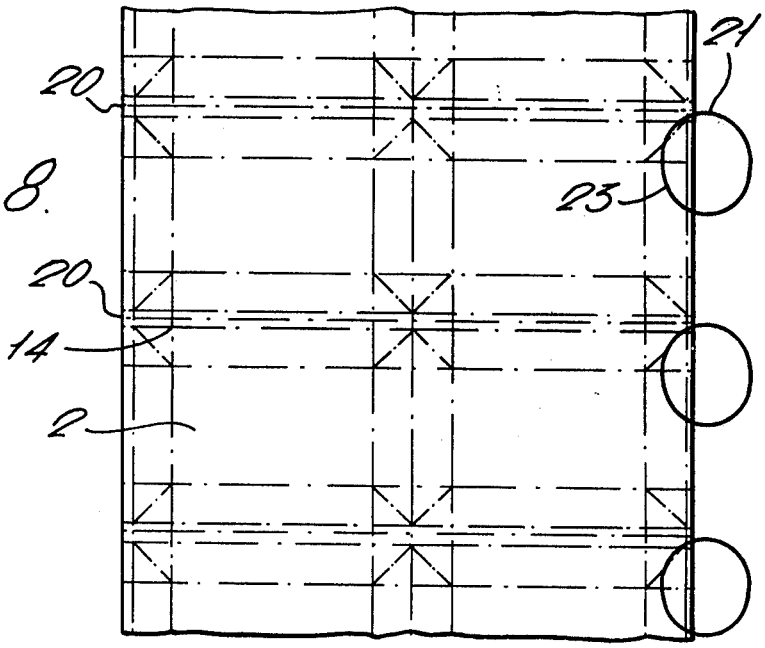
Figure 9:
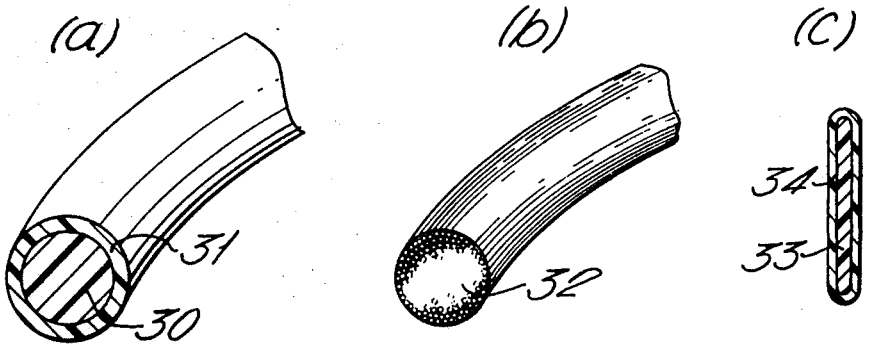
Figure 10:
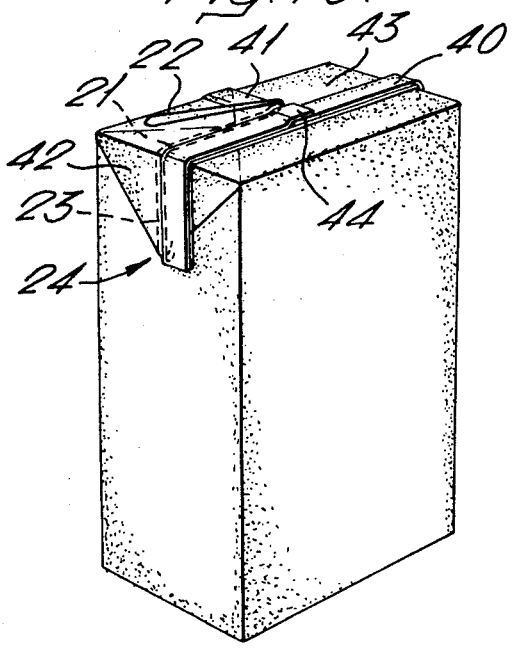
Figure 11:
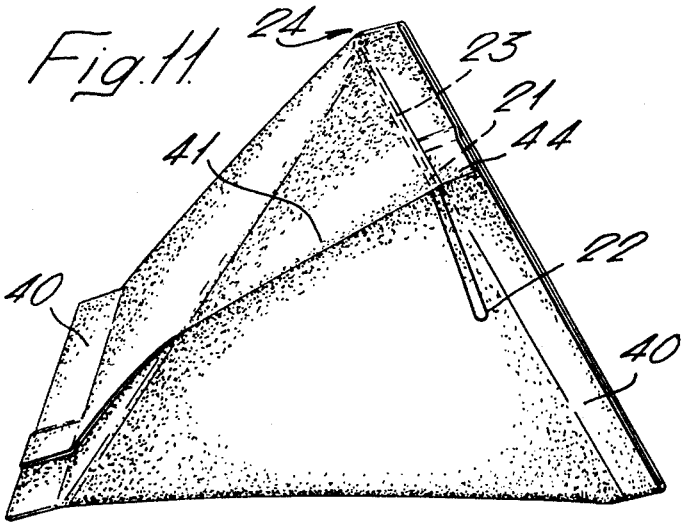
Figure 12:
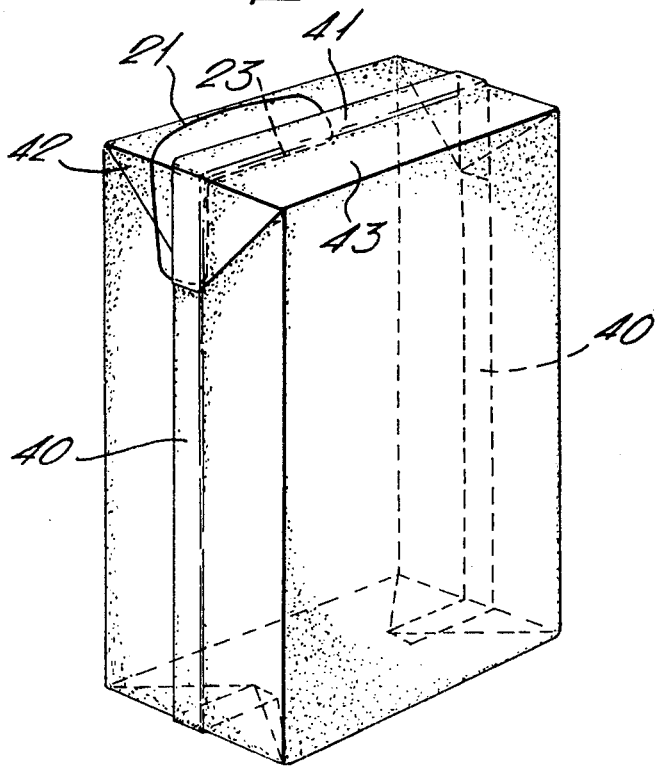
Figure 13:
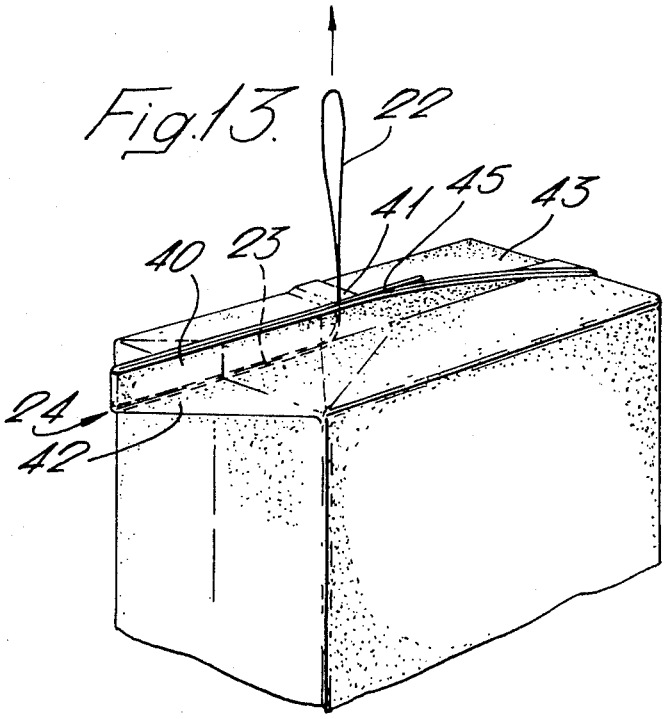
Figure 14:
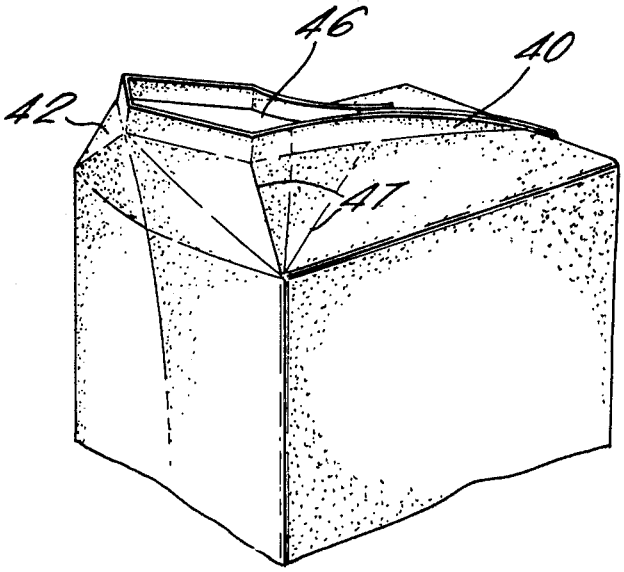

In the following a few embodiments of the invention will be described with reference to the enclosed schematic drawing, in which FIG. 1 shows schematically a device for the conversion of a packing material web to tetrahedron-shaped packages, FIG. 2 shows schematically a device for the conversion of a packing material web to parallelepipedic packages, FIG. 3 shows another device for the conversion of a packing material web to parallelepipedic packages, FIG. 4 shows a packing material web with a ripping thread laid on, FIG. 5, 6 and 7 show a packing material web with a continuous ripping thread laid on, FIG. 8 shows a packing material web with annular ripping threads applied, FIG. 9*a* shows a ripping thread in strong enlargement, FIG. 9*b* shows a multicore ripping thread in strong enlargement, FIG. 9*c* shows a ripping strip in strong enlargement, FIG. 10 shows a parallelepipedic package with ripping thread, FIG. 11 shows a tetrahedron-shaped package with ripping thread, FIG. 12 shows a parallelepipedic package with annular thread opening, and FIG. 13 and 14 show different stages of the opening operation of the parallelepipedic package shown in FIG. 10.

For better clarity in the first place, with the help of FIG. 1, 2 and 3, three different systems are shown for the manufacture of packing units from a web which is converted to a tube, and by which packing systems packing containers with thread opening in accordance with the invention can advantageously be manufactured. The different packing material webs with ripping threads laid on in different patterns will be described with reference to FIG. 4–8, and different types of ripping threads which are shown in FIG. 9 and whose manufacture will be discussed. Finally different types of finished packing containers with ripping opening will be described with reference to FIG. 10–14.

The schematic device for the manufacture of tetrahedron-shaped packages represented in FIG. 1 has a supply roll 1 from which can be wound off a plane material web 2. The web is passed over a guide pulley 4 with the help of which the web 2 can be deflected so that it performs a downwards directed movement, whereupon it is formed by means of the forming member 6 to a tube 9 the longitudinal edges of which are united and welded together to a longitudinal joint, in that the thermoplastic coating of the web is warmed up to activation and layers of the warmed-up plastic material placed against each other are pressed together so that a surface fusion of the thermoplastics is obtained. This longitudinal joint sealing is carried out with the devices 8, whereupon the tube 9 formed is filled with the filling material through the filling tube 10, which ends inside the tube 9. By means of sealing jaws, which are not shown the tube is now pressed together and sealed along narrow sealing zones perpendicular to the tube axis, where successive sealing zones are set at an angle and so in relation to one another that a series of tetrahedron-shaped bodies 12 are formed. The tetrahedron-shaped bodies 12 are then separated from the tube 9 and packed in trays 13 for distribution.

In the packing machines shown schematically in FIG. 2, parallelepipedic packages 3 are manufactured in the manner as described earlier, in that a packing material web 2 is wound off from a supply roll 1 to be then passed over the guide pulley 4, whereupon the web 2 is successively converted to a tube 9 by means of the forming device 6. In the manner described earlier the overlapping edges of the web 2 are sealed to one another with the help of the sealing device 8 to a longitudinal tube joint. The intended filling material is filled into the tube through the filling tube 10, whereupon the lower part of the tube by successive transverse sealings with sealing devices not shown here, is divided along sealing zones 11 situated at a distance from one another whilst the lower parts of the tube which have been sealed off are upset to form parallelepipedic packages 3, which are separated from the tube 9 and whose double-walled triangular lugs 5 formed are then folded in against the side walls or the end walls of the package so that a parallelepipedic body without substantially projecting parts is obtained.

With the help of the packing machine in accordance with FIG. 3 similar parallelepipedic packages 3 are manufactured, and as was the case in the earlier described packing machines, a packing material web 2 is wound off from a supply roll 1. In the packing machine in accordance with FIG. 3 however, the web is folded double with the help of guide surfaces 7 and the double-folded web is passed over a guide pulley or a redirecting surface 4 with large diameter. The tube formed in a flat shape is sealed along its longitudinal joints with the help of a longitudinal sealing device 8 and the intended filling material is introduced directly before the sealing of the longitudinal joints through a filling pipe 10. To facilitate the subsequent forming the packing material web 2 is provided with a line pattern 14 facilitating the formation of folds, and the forming is done as in the packing machine according to FIG. 2 by an upsetting of the lower part of the tube 9 in such a manner that triangular, doublewalled lugs are formed at the corners of the packages. After the ready-formed packages 3 have been separated from the tube 9 the triangular lugs are folded in in the aforementioned manner and are fixed against the side walls or end walls of the package. At the formation of the tube by means of the packing machine shown in FIG. 3 the longitudinal edges of the web 2 are not united in an overlap joint but in a joint inside against inside, which implies that the longitudinal joint of the tube will appear as an outer sealing fin on the packing container 3 which is manufactured with the help of the machine. As can be seen from FIG. 3 the parallelepipedic bodies 3 which are manufactured have a width which is greater than their height, and in contrast with what happens in the packing machine according to FIG. 2 the packing units are delivered in the machine according to FIG. 3 therefore with their longitudinal axis transversely to the longitudinal axis of the web. The transverse seals of the tube 9 in the packages which are manufactured in accordance with FIG. 3 will thus be placed along the sides of the packing containers, whilst the longitudinal sealing joint of the tube 9 will be placed at the upper wall surface of the packing container 3 and extend over the said double-walled triangular lugs located at the upper end surface of the packing containers up to the points of the same. This will mean that the sealing fins, which will be located at the upper end wall of packages which have been manufactured in accordance with FIG. 3, actually constitute the longitudinal joint of the packaging material tube, whilst the corresponding sealing fins along the upper wall surface of the packages which have been manufactured in accordance with FIG. 2 constitute a transverse joint of the packing material tube.

In the introductory descriptions given here of the different types of packing machines for the manufacture of packages from a web, which is folded to a tube, only the basic procedure in the conversion of the packing material to packages has been discussed, whilst on the other hand the opening facilities with a ripping thread in accordance with the invention has not been dealt with. The packing containers in accordance with the invention can be manufactured, however, by means of the packing machines shown in FIG. 1–3 provided that the ripping threads are applied to the packing material web in accordance with what will be described in the following.

In the following it is assumed that the packing material web 2 can be fed by a controlled feed mechanism, so that the printed text on the packing material web, the line pattern arranged for facilitating the formation of folds and also the ripping threads will be located at the intended places in the finished package, that is to say, in as far as the ripping threads are concerned, directly under the sealing joint which is intended to be cut open by the ripping thread.

In FIG. 4–8 are shown sections of packing material webs which are intended to be used in the earlier described packing machines for the manufacture of packing containers. The packing material webs which are designated by numeral 2 are provided with line patterns 14 to facilitate the forming work of the tube formed from the web 2, and, as mentioned earlier, the web must be advanced in register with the said pattern, so that the forming can take place and the ripping threads be placed in the right position. A section of the packing material webs which corresponds to a packing unit is constituted by the distance between two successive dash-dotted lines 20, which designate the area of the web 2 which will be localized to the transverse joint of the tube, and the tube formed by the web 2 will likewise be separated after flattening and sealing along the lines 20. The folding line pattern 14 is also shown in dash-dotted lines and the part of the folding line pattern which is intended to form the triangular double-walled lug of the packing container, designated to form the pouring spout, is designated by 24.

As can be seen from FIG. 4 the packing material web 2 is provided with ripping threads 21, which are double-folded and applied at a right angle to the longitudinal direction of the web directly under the sealing and separating region 20 of the web. The ripping thread 21 extends with its two main parallel parts 23 across the web as far as or past the point 24, whilst a part 22 of the ripping thread 21 which forms a loop is located outside the right edge of the web. The part of the ripping thread 21 which is situated inside the web edge is sealed to the side of the web 2 which is intended to form the inside of the packing container and which is provided with a coat of a thermoplastic material, e.g. polythene. As will be reported in the following, the ripping thread 21 is then also preferably provided with a coat of thermoplastic material, which before application of the ripping thread is warmed up to soften so that the ripping thread 21, when it is pressed to the packing material web adheres to the same with great adhesion force. The construction of the ripping thread will be described in detail later.

In FIG. 5 is shown another version of the web with laid on ripping thread, the packing material web 2 as such being of similar appearance as the web shown in FIG. 4. The ripping thread 21, however, in FIG. 5 is laid on as a continuous thread 21, which in certain cases facilitates an automatic application. Thus it is possible at the application of ripping thread 21 in accordance with FIG. 5 to apply the thread with a thread guide which at the same time rolls out the thread 21 against the web 2, warms up the thread and heat-seals it to the inside of the web 2, the thread guide being laterally displaced each time it comes to pass the regions 20 so as to form a loop 22 outside the edge of the web, and again to be guided across the web past the point 24 so that two parallel threads 23 will be located directly below the sealing and separating regions 20. The inconvenience of the method in accordance with FIG. 5 lies in the fact that a certain waste of thread occurs, since the ripping thread 21 which is laid along the web 2 in the longitudinal direction of the same between successive ripping regions cannot be utilized, and it is a further disadvantage that the ripping thread 21 cannot be removed after the package has been ripped open. An advantage, on the other hand, consists in the fact that the thread cannot be torn out without the desired opening being ripped open at the same time. A third version of the same packing material web 2 is shown in FIG. 6 where the ripping thread 21 is continuous and is laid on in bends 23 with parallel parts directly below the sealing and separating regions 20, whereby care has to be taken that the bends do extend past the point 24 so that the package is ripped open right to the tip of the triangular lugs. If the ripping thread is laid on in accordance with what is shown in FIG. 6, the same large wastage of thread does not arise, since the part of the ripping thread 21 situated outside the edge of the packing material web 2 will be able to serve as a grip at the opening of the packing container.

The packing material webs as shown in FIG. 4, 5 and 6 are all intended to be used in a packing machine in accordance with FIG. 2, that is to say a packing machine where the transverse joints of the tube formed will be localized to the top of the packing container and thus a part of the said sealing joint is intended to be torn open up to the tip of the triangular lug when the package is opened.

The same type of ripping thread application as shown in FIG. 4, 5 and 6 can be ussed in packing material webs which are intended to be converted to packages in a packing machine in accordance with FIG. 1, that is to say to tetrahedron-shaped packages. In this case, however, the packaging material web is not provided with any folding line pattern 14, but naturally the ripping threads 21 which are laid onto the web and fixed to the same must be located directly below the region which is intended to form the transverse joints of the tube.

In FIG. 7 and 8 is shown another type of packing material web 2 which is intended to be used in a packing machine of the type which is described in connection with FIG. 3. As mentioned earlier the packing containers are manufactured on this machine with their longitudinal direction transverse to the longitudinal direction of the tube, so that the upper end face of the packing containers, whose sealing fin is to be torn open at the opening of the package, will be located in the web 2 along the one longitudinal edge of the web, in this case the right hand edge, so that the ripping thread 21 with one part 23 is situated directly below a separating and sealing region 20 of the tube formed by the web 2, whilst another part 25 of the ripping thread 21 is situated outside the edge of the web in the manner as shown in FIG. 7. When the web 2 in the packing machine is double-folded about its centre-line and both edge regions of the web 2 are united in a longitudinal joint, inside against inside, a part of the thread 21, namely the part 23, will thus become located directly inside the longitudinal joint of the tube, whilst the part 25 of the thread 21 will be located outside the longitudinal joint of the tube, whilst the parts of the ripping thread which are situated between the parts 23 and 25 will be located in the longitudinal joint of the tube. When the packing material web is converted to parallelepipedic packages the part 25 of the ripping thread will form a freely separated thread-end accessible from the outside of the package, whilst the threadpart 23 will be located just inside the sealing joint which extends from the upper end surface of the package over the one upper triangular lug to the tip of the lug. When the part of thread 25 is gripped by hand and ripped upwards, the sealing joint above the thread-part 23 will be torn up and an opening will be formed from which the filling material of the packing container can be poured.

In FIG. 8 is shown a further version of the same packing material web 2, where, however, the ripping thread 21 consists of rings which are placed on the one edge of the packing material web, so that a part 23 of the annular ripping thread 21 is located inside the edge of the web and is fixed to the inside of the packing material web, whilst another part of the ripping thread 21 is located outside the edge of the packing material web 2. In the manner which has been described earlier the ripping thread is located so, that the front part of the same will be placed within the region 20, along which the tube formed by the web is transversely sealed and separated. When the package formed by the packing material web 2 is to be opened the annular thread 21 is ripped off whereby the upper end face of the sealing joint at the packing container is cut up to the tip of the triangular lug, so that an emptying opening for the filling material is formed.

As a ripping thread a textile thread or a plastic thread of such a plastic material may be used which has a relatively small elongation, e.g. polyester. Owing to the property of textile threads of absorbing liquid they are less suitable as ripping threads, and a ripping thread of plastic material is thus preferred.

Polyester material, or other plastic material with comparable strength characteristics and stretch characteristics, has as a rule a melting range which is far higher than the melting range of for example polythene, which is the most usual coating material on a packaging material web and it is difficult therefore to heat-seal a ripping thread of polyester to a polythene layer. To make possible a fixing by means of heat-sealing of the ripping thread which is shown in FIG. 9*a* to the plastic coating of the packing material it is appropriate therefore to cover the ripping thread 30 in advance with a more easily melting coating 31 of polythene or with a so-called hotmelt, that is to say a material mixture with thermoplastic properties and with maximum adhesive properties in hot condition. Such hotmelt material may consist for example of mixtures of polyolefins and waxes which are blended in such proportions that a material with desirable melting range is obtained. This coating of the thread 30 can be carried out so that the ripping thread 30 is dipped into a bath of polyolefin material or hotmelt material heated up to melting, or else it is dipped into a bath of e.g. polythene dissolved in toluene or some other suitable solvent which evaporates when the dipped thread is dried, leaving behind a film of polythene material.

It was found to be of great importance that good adhesion is ensured between the ripping thread and the packing material, since it would be easy otherwise to pull the thread from the packing material without any tearing open of the package having been achieved. A good adhesion force is achieved when the contact surface or the sealing surface between the thread and the packing material web is large and it has therefore proved advantageous to divide the thread into a large number of fine threads each being provided with an easy-melting plastic coating of e.g. polythene or hotmelt. such a loosely twined multicore ripping cord 32 as shown in FIG. 9*b* is flattened out on compression, which means that the cord, when it is pressed against the packing material web after previous warming up with a view to activating the coating material, will be flattened out so that a large contact surface between the cord and the web is obtained, and consequently a strong adhesion. By virture of the fact that each of the individual threads making up the ripping cord 32 according to FIG. 9*b* is coated with easy-melting polyolefin material or hotmelt each capillary channel occurring is sealed when the ripping cord is pressed together, which means that the ripping cord does not have any suction effect, and so as to ensure even further that the ripping cord does not absorb liquid it may be suitable to sever the ripping cord with the help of a hot knife, which melts together the different threads at the end portions of the ripping cord and thus seals off the ends of the ripping cord which cause most trouble with regard to absorption and which generally initiate the same. This multi-core cord 32 has moveover the property that, unlike a single thread, it does not cut into the fingers when the ripping cord is manoeuvred by hand for the opening of a package.

A further variant of the ripping thread is shown in FIG. 9*c* where the thread is substituted by a strip 33 which also advantageously will be covered with an easy-melting coating 34 so as to obtain a redily achievable and durable seal. The ripping strip 33 has the advantage, that it is homogeneous and thus has no capillary channels which have to be sealed off for preventing the absorption of liquid. The ripping strip has furthermore the advantage that the sealing surface is large, so that it can be attached by means of heat-sealing to the packing material web with great strength. On the other hand, the ripping strip 33 occasionally gives inferior ripping results and is more difficult to rip.

It has been found in certain cases that it is suitable to make the ripping thread with such a small diameter that it is less than the thickness of the plastic layer in the sealing region which is to be ripped open. It has been found that a ripping thread of a diameter so adapted will cut through the plastic material in the sealing region so that on the insides of ripped up joints often a plastic layer is left behind on both sides of the joint. If the ripping thread 21 is too thick in relation to the thickness of the plastic layer in the region of the joint, some parts of fibrous material which are always adjoining the plastic layer, if the casing of the packing material consists of paper, are pushed aside, which means that the opening region has a less pleasing appearance with torn up paper fibres and loosely hanging plastic edges.

What has been said above is however not applicable to all types of packing material and all ripping threads, but it has also proved possible by means of for example a multi-core ripping thread 21 to tear up a joint region without the same being torn to shreds, probably because the ripping thread, by virtue of its capacity to flatten itself out, forms itself in a suitable manner in the ripping zone so that any unnecessary tearing to shreds of the packing material is prevented.

It has been mentioned earlier that a multi-core ripping cord has some advantages, but that there is a risk of liquid absorption through the cord if the capillary channels of the same are not sealed in a satisfactory manner. Beside the abovementioned method of coating the individual threads or the whole cord with a plastic material, it is also possible to intertwine threads of a low-melting plastic material, e.g. polythene, together with threads of a higher melting plastic material, e.g. polyester. The low-melting plastic material in the ripping thread is then made to melt and flow out in the region of the passage of the ripping thread through the longitudinal joint in conjunction with the longitudinal joint sealing of the tube being carried out. By virtue of the sealing off on the one hand of the capillary channels in the said region, and by the sealing off on the other hand of possible channels in the longitudinal joint caused by the passing through of the ripping cord, a completely tight leadthrough for the ripping cord is assured. This is a precondition for the use of packages in accordance with the invention for the packing of sterilized filling goods.

The flat ripping strip shown in FIG. 9*c* need not necessarily be manufactured of a homogeneous plastic material, but it is also possible to twine or weave a flat ripping cord containing several threads. A certain portion of these can be threads of a lower melting plastic material, or else the threads can in the manner that has been described be coated with a layer of a relatively low-melting plastic material.

In cases where owing to the structure or the rigidity of the packing material web it is difficult wholly to eliminate leakage channels in the longitudinal joints in the region where the ripping cord passes through the joint, it is possible to apply locally, on the one border region of the web in the region of the passage of the ripping thread, a layer of a sealing, low-melting plastic material or hotmelt.

In FIG. 10 is shown a parallelepipedic packing container, which is manufactured on a packing machine in accordance with FIG. 2 using a packing material web in accordance with FIG. 4. As is apparent from FIG. 10 the upper end surface 43 of the packing container is provided with a sealing joint 40, which extends over the end surface 43 and over the triangular lugs 42 which are joined to opposite sides of the end surface 43. The sealing joints or sealing fins 40 constitute transverse joints of the tube from which the packing container has been made, and in the region 44 this transverse sealing joint 40 is crossed by the longitudinal joint 41. As previously, the ripping thread is designated by 21 and the part of the ripping thread 21 which is fixed against the packing material web 2 which is shown in FIG. 4 is designated by 23. As shown on FIG. 10 the ripping thread 21 with its parallel parts 23 is located directly below the sealing fin 40 and the loop 22 of the ripping thread accessible from the outside of the packing container projects through the longitudinal joint 41 just below the transverse joint 40. To prevent the freely projecting loop 22 of the ripping thread 21 during the formation of the tube to the parallelepipedic packing container from coming in between the sealing jaws during the accomplishment of the transverse sealing 40, it is appropriate as shown in FIG. 10, to fold the loop 22 over the edge of the web against the side of the packing material web which is intended to form the outside of the package and to fix the loop 22 against the web of the packing material with an easily breakable seal in such a position that the loop will not be introduced into the sealing region. In the example shown here the loop 22 of the ripping thread 21 is laid obliquely towards the side reckoned from the sealing region 40, which can easily be done on the packing material web in accordance with FIG. 4 if the loop 22 is folded over with the help of guiding surfaces or guiding rollers which are stationary, seeing that when the loop 22, owing to the forward movement of the web, will be deflected automatically in a direction which is opposite to the movement of the web.

As is apparent from FIG. 10 the parallel parts 23 of the ripping thread 21 are arranged so that they extend past the corner points 24 of the triangular lugs 42, which is also apparent from FIG. 4 where the corresponding point 24 is marked with an arrow. Owing to the fact that the ripping thread 21, if it is shaped in accordance with e.g. FIG. 9*b*, can be strongly flattened it was found that no leakage channels occur in the longitudinal tube joints 41, in spite of the ripping thread 21 going through the said longitudinal joint.

In FIG. 11 is shown a tetrahedron-shaped package which is provided with a ripping strip 21. As mentioned earlier the tetrahedron-shaped package shown in FIG. 11 can in principle be made from the web 4, but it is not required then for the web to be provided with a folding line pattern 14, but the packages automatically assume tetrahedron shape if the transverse seals 40 of the tube are placed at an angle in relation to one another. The tetraedron-shaped package is also provided with a longitudinal tube joint 41 and, as in the case of FIG. 10, the longitudinal and the transverse tube joints 41 and 40 respectively cross one another in a region 44 which is called the joint cross. The loop of the ripping thread 21 projects through the longitudinal joint 41 directly below the region 44, that is to say directly below the transverse joint 40, and the parallel parts 23 of the ripping thread 21 are located below the transverse sealing fin 40 and extend up to and around the point 24, which corresponds to the point 24 in FIG. 4. In this instance too the loop 22 of the ripping thread 21 is brought out of the transverse joint region 40, and it is of course possible in the manner as shown in FIG. 10 to fold the loop 22 over the edge of the web and fix it against the outside of the package, although this is not shown in FIG. 11.

The ripping thread 21 in packages in accordance with FIG. 10 and 11 can also be arranged in the manner shown in FIG. 5 and 6, which intend to illustrate packing material webs with different ripping thread pattern. The principle is the same, however, as shown in the packages of FIG. 10 and 11, which are made from the web shown in FIG. 4.

In FIG. 12 is shown a parallelepipedic package which has been made on a packing machine in accordance with FIG. 3 and of a packaging material web in accordance with FIG. 8. As is apparent from FIG. 12 the packing container is parallelepipedic, and its upper end face 32 presents a sealing fin or sealing joint 41 extending over the end face which also extends over the adjoining triangular double-walled lugs 42 up to the tips of these. Differently from the parallelepipedic package as shown in FIG. 10 the sealing fin or sealing joint 41 on the present package, which extends over the top end wall 43 is the longitudinal joint in the tube, from which the packing container is formed, whilst the transverse joints which divide the said tube in inside against inside seals are found again at the opposite side walls of the packing container and are designated by 40. Since in the packing container in accordance with FIG. 12 the longitudinal and the transverse tube joints are all of the type, inside against inside, the transverse joints and the longitudinal joints coincide to a common sealng region, so that a so-called cross (corresponding to the region 44 in FIG. 10) is not formed.

In the packing container in accordance with FIG. 12 an annular ripping thread is put in the web in the manner as shown in FIG. 8, and the part 23 of the ripping thread which is fixed against the web will be located below the sealing fin 41, which thus constitutes the longitudinal joint of the tube, from which the package has been made. The ripping thread 21 is located so at the edge of the packing material web, that it will extend right to the transverse tube joint 40 and thus to the tip of the triangular lug 42. When the ripping thread 21 is torn off the sealing joint 41 splits up along the region 23 and the packing container can be opened in that the triangular lugs 42 are put up and the fissure formed in the sealing joint 41 is widened to an emptying hole, from which the filling goods can be poured out.

It is also possible, in the manufacture of packages, to make use of a packing material web in accordance with FIG. 7. and we obtain then, instead of a pulling loop which is formed by a part of the annular ripping thread 21, a free-hanging ripping thread part, which in the manner as described earlier has to be brought out from, in this case, the longitudinal joint sealing region e.g. by folding it about the web edge.

In FIG. 13 and 14 is illustrated how the packing container in accordance with FIG. 10 is opened and the procedure at the opening of the remaining packing container is similar and there is no need to describe it in detail.

When the packing container in accordance with FIG. 10 is to be opened so as to make accessible the filling material, in the first place the lug 42 is raised so that it comes to lie practically in the same place as the upper end face 43 of the packing container. Subsequently the loop 22, which is fixed to the upper end face 43 of the packing container by means of an easily breakable seal, is made loose. The loop 22 of the ripping thread 21 is then pulled upwards, which is indicated in FIG. 13 by an arrow, whereby the ripping thread 21 with its parts 23 located under the sealing joint 40 will cut through the sealing joint 40, which is torn up along the region 45. When the pulling of the ripping thread 21 is continued the joint 40 will successively be torn up along its whole length up to the corner point 24 of the triangular lug 42, whereupon the ripping cord 21 when it has been torn out is loosened and can be thrown away.

The opening that has been made in the packing container can be widened by a light pressure against the sides of the package in the region of the basis of the triangular lug 42, whereby the triangular lug and adjoining parts of the torn up sealing joint 40 and the upper end face 43 of the packing container together form a rhomboidal opening 46 which is shown in FIG. 14. To facilitate the formation of the said rhomboidal pouring opening 46 it is appropriate for the upper end face 43 of the package to be provided with auxiliary folding lines 47 which on the one hand facilitate the formation of the pouring spout, on the other hand stabilize the pouring spout and its opening area 46, so that the rhomboidal opening formed does not collapse again to form a narrower opening, which, should it happen during the pouring operation, would bring about a risk of spillage.

The embodiments shown here are intended only to exemplify the invention and it is thus possible within the framework of the concept of the invention to modify the construction of the packages as well as the appearance, material composition and pattern of application of the ripping thread.

We claim:

1. In a method of continuously producing containers from a web of carton forming material having a layer of thermoplastic material on that side which will form the inside of the container, which includes forming the web into a longitudinal tube-like member, sealing together the longitudinal edges thereof, filling the tube-like member with a filling material, forming spaced face-to-face seals transversely of the length of the tube-like member to form a plurality of interconnected containers and cutting through the transverse seals longitudinally thereof to separate the packages from one another, the improvement comprising securing the substantially parallel legs of each of a plurality of substantially U-shaped tear threads to the layer of thermoplastic material at spaced locations along the length of the web and transversely thereof, the spaced locations of the parallel legs of each tear thread being juxtaposed the inner edge of the location where the transverse face-to-face seal is to be formed, the loop-like portion of each tear thread extending beyone one marginal edge of the web so that the inner portions of the parallel legs pass transversely through the longitudinal seal when sealing the edges of the web to form the tube-like member, folding the extended loop-like portions back against the side of the web which will form the outside of the container and away from the location where the transverse seal is to be formed and releasably securing the folded loop-like portions to the web so that each tear thread and extended loop-like portion thereof for each container will remain intact when cutting the transverse seals to separate the containers, the extended loop-like portions of each tear thread forming an external grip for pulling the thread to open the container by separating at least a portion of the adjacent face-to-face transverse seal to provide access to the filling material therein.

2. In a method as claimed in claim 1 the improvement wherein at least a portion of the parallel legs of the tear threads are secured to the layer of the thermoplastic material.

3. In a method as claimed in claim 1 the improvement wherein the tear threads are coated with a thermoplastic material having a softening point at least as low as the thermoplastic material forming the layer.

4. In a method as claimed in claim 1 the improvement wherein the tear threads are each composed of a plurality of entwined fine threads composed of a plastic material and wherein the substantially parallel legs of the tear threads are secured to the layer of thermoplastic material by heat pressing the threads thereagainst to secure and flatten the tear threads.

5. In a method as claimed in claim 4 the improvement wherein each of the fine threads is coated with a thermoplastic material having a softening point below that of the fine threads and wherein the entwined tear threads are coated with the same thermoplastic material as is coated on each fine thread.

6. In a method as claimed in claim 3 wherein the tear theads are composed of a polyester and the coating on said tear threads is a material selected from the group consisting of a polyolefin and a mixture thereof with a wax.

7. In a method as claimed in claim 1 the improvement wherein said tear threads are composed of single homogeneous flat plastic bands.

8. In a method as claimed in claim 1 the improvement wherein at least the substantially parallel legs of each tear thread secured to the layer of thermoplastic material is thinner than the thickness of the layer.

* * * * *